US010962280B2

(12) United States Patent
Jang et al.

(10) Patent No.: US 10,962,280 B2
(45) Date of Patent: Mar. 30, 2021

(54) REFRIGERATOR

(71) Applicant: Samsung Electronics Co., Ltd, Suwon-si (KR)

(72) Inventors: Myoung Jin Jang, Suwon-si (KR); Yong Man Seo, Suwon-si (KR); Jae Bok Lee, Suwon-si (KR); Sang Gyu Jung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 16/447,907

(22) Filed: Jun. 20, 2019

(65) Prior Publication Data

US 2019/0390894 A1 Dec. 26, 2019

(30) Foreign Application Priority Data

Jun. 20, 2018 (KR) ..... 10-2018-0070658

(51) Int. Cl.
*F25D 25/02* (2006.01)

(52) U.S. Cl.
CPC ..... *F25D 25/02* (2013.01); *F25D 2325/021* (2013.01); *F25D 2325/022* (2013.01)

(58) Field of Classification Search
CPC ..... F25D 25/02
USPC ..... 312/401, 408, 351; 108/107, 108; 211/153
See application file for complete search history.

(56) References Cited

U.S. PATENT DOCUMENTS 5,813,741 A * 9/1998 Fish ..... F25D 25/024 108/108
8,926,034 B2 * 1/2015 Park ..... A47B 96/027 312/408
2015/0192347 A1 7/2015 Cho et al.
2015/0226474 A1 8/2015 Choi et al.
2015/0253064 A1 * 9/2015 Kim ..... F25D 25/024 312/408

(Continued)

FOREIGN PATENT DOCUMENTS

KR 10-0763944 B1 10/2007
KR 10-2012-0097550 A 9/2012

(Continued)

OTHER PUBLICATIONS

ISA/KR, International Search Report and Written Opinion of the International Searching Authority, International Application No. PCT/KR2019/007415, dated Oct. 7, 2019, 9 pages.

*Primary Examiner* — James O Hansen

(57) ABSTRACT

A refrigerator includes a main body, a storage chamber formed in the main body, a shelf support portion provided at a rear side of the storage chamber, a plurality of shelves coupled to the shelf support portion so that the shelves are arranged next to each other, and an adjustment member coupled to the shelves so as to remove a height difference between the plurality of shelves. Coupling grooves are respectively formed in the shelves. The adjustment member is inserted into the coupling holes of the shelves and then rotates by a predetermined angle such that the adjustment member is fixed to the shelves. The adjustment member maintains a constant interval between the shelves and prevents the shelves from moving relative to each other. The adjustment member is easily coupled to and separated from others.

16 Claims, 17 Drawing Sheets

(56) References Cited

U.S. PATENT DOCUMENTS

| | | | | |
|---|---|---|---|---|
| 2016/0037917 | A1* | 2/2016 | Li | A47B 96/021 211/74 |
| 2018/0017315 | A1 | 1/2018 | Choi et al. | |

FOREIGN PATENT DOCUMENTS

| | | | |
|---|---|---|---|
| KR | 10-2015-0003630 | A | 1/2015 |
| KR | 10-2015-0094049 | A | 8/2015 |
| KR | 10-2016-0094734 | A | 8/2016 |
| KR | 10-2018-0007772 | A | 1/2018 |

* cited by examiner

REFRIGERATOR

CROSS-REFERENCE TO RELATED APPLICATION

This application is based on and claims priority under 35 U.S.C. § 119 to Korean Patent Application No. 10-2018-0070658 filed on Jun. 20, 2018 in the Korean Intellectual Property Office, the disclosure of which is incorporated by reference in its entirety.

BACKGROUND

1. Field

Embodiments of the present disclosure relate to a refrigerator provided with at least one shelf allowing food to be placed thereon, and more particularly to a refrigerator provided with an adjustment member that removes a height difference between plural shelves arranged next to each other.

2. Description of the Related Art

Generally, a refrigerator is an appliance which has a main body provided with a storage chamber therein and a cold air supply device supplying cool air to the storage chamber, thereby storing food in a fresh state.

The storage chamber is provided with at least one shelf allowing food to be placed thereon, a sealed container to store food in a sealed state, etc. A shelf support portion connectable to the shelf may be provided at a rear side of the storage chamber. A plurality of shelf hanger grooves arranged in a vertical direction may be formed in the shelf support portion. The shelf may be selectively coupled to a specific shelf hanger groove between the plurality of shelf hanger grooves of the shelf support portion, such that a height of the shelf can be adjusted.

A plurality of shelves may be coupled to the shelf support portion such that the shelves can be placed next to each other. The shelves may be respectively supported by the shelf support portion provided in the rear of the storage chamber in a cantilever manner, such that a height difference between the shelves may occur due to the weight of foods placed on the shelves. Alternatively, a height difference between the shelves may also occur either by errors in a fabrication process of the shelves or the shelf support portion or by errors in an assembly process of the shelves and the shelf support portion.

SUMMARY

Therefore, it is an aspect of the present disclosure to provide a refrigerator having an adjustment member coupled to a plurality of shelves so as to remove a height difference between the plurality of shelves arranged next to each other.

It is another aspect of the present disclosure to provide a refrigerator having an adjustment member which maintains a constant interval between the plurality of shelves and prevents the plurality of shelves from moving relative to each other.

It is another aspect of the present disclosure to provide a refrigerator having an adjustment member which is easily coupled to and separated from others, resulting in improved usability.

Additional aspects of the invention will be set forth in part in the description which follows and, in part, will be obvious from the description, or may be learned by practice of the invention.

In accordance with an aspect of the present disclosure, a refrigerator includes a main body, a storage chamber formed in the main body, a shelf support portion provided at a rear side of the storage chamber, a plurality of shelves coupled to the shelf support portion so that the shelves are arranged next to each other, and an adjustment member coupled to the shelves so as to remove a height difference between the plurality of shelves. Coupling grooves may be respectively formed in the shelves. The adjustment member may be inserted into the coupling holes of the shelves and may then rotate by a predetermined angle such that the adjustment member is fixed to the shelves.

Each of the coupling holes may include a center region formed in a circular shape, and a guide region formed to extend in a radial outward direction from the center region.

The adjustment member may include a cylindrical rod portion extending to be inserted into the coupling holes of the shelves, and a stopper portion formed to protrude in a radial outward direction from the cylindrical rod portion so that the stopper portion is caught by any one of the shelves.

The rod portion may have a cross-sectional region corresponding to a shape and size of the center region.

The stopper portion may have a cross-sectional region corresponding to a shape and size of the guide region.

The stopper portion may include a center stopper provided to be caught between the shelves.

The stopper portion may include an auxiliary stopper provided to be spaced apart from the center stopper so that the auxiliary stopper is caught by any one of the shelves.

The adjustment member may include a grip portion protruding in a radial outward direction from the rod portion so that the grip portion is spaced apart from the center stopper and is grasped by a user hand.

The grip portion may be caught by any one of the shelves such that an insertion depth of the adjustment member is restricted when the adjustment member is inserted into the coupling holes of the shelves.

The adjustment member may be inserted into the coupling holes of the shelves in a longitudinal direction of the rod portion, and is fixed to the shelves by rotating about a longitudinal center axis of the rod portion.

Each of the shelves may include a shelf plate allowing food to be placed thereon, and a hanger coupled to the shelf support portion so as to support the shelf plate.

The hanger may include a horizontal portion formed parallel to the shelf plate, and a vertical portion extending downward from the horizontal portion.

In accordance with another aspect of the present disclosure, a refrigerator includes a main body, a storage chamber formed in the main body, a shelf support portion provided at a rear side of the storage chamber, a first shelf configured to include a first shelf plate and a first hanger coupled to the shelf support portion so as to support the first shelf plate, a second shelf arranged next to the first shelf, and configured to include a second shelf plate and a second hanger coupled to the shelf support portion so as to support the second shelf plate, and an adjustment member coupled to the first shelf and the second shelf so as to remove a height difference between the first shelf and the second shelf. The first hanger may be provided with a first coupling hole, and the second hanger may be provided with a second coupling hole. The adjustment member may include a rod portion extending to be inserted into the first coupling hole and the second coupling hole, and a stopper portion protruding from the rod portion so as to be caught by any one of the first hanger and the second hanger.

The adjustment member may be rotatable in a manner that the stopper portion is caught by at least one of the first hanger and the second hanger in a state in which the rod portion is inserted into the first coupling hole and the second coupling hole.

Each of the first coupling hole and the second coupling hole may include a center region formed in a circular shape, and a guide region formed to extend in a radial outward direction from the center region.

The rod portion may have a cross-sectional region corresponding to a shape and size of the center region.

The stopper portion may have a cross-sectional region corresponding to a shape and size of the guide region.

The adjustment member may include a grip portion protruding in a radial outward direction from the rod portion so that the grip portion is grasped by a user hand.

The stopper portion may include the center stopper and an auxiliary stopper. The first hanger may be inserted between the auxiliary stopper and the center stopper, and the second hanger may be inserted between the center stopper and the grip portion.

The stopper portion may include a first lateral stopper and a second lateral stopper. The first hanger may be inserted between the first lateral stopper and the grip portion, and the second hanger may be inserted between the grip portion and the second lateral stopper.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
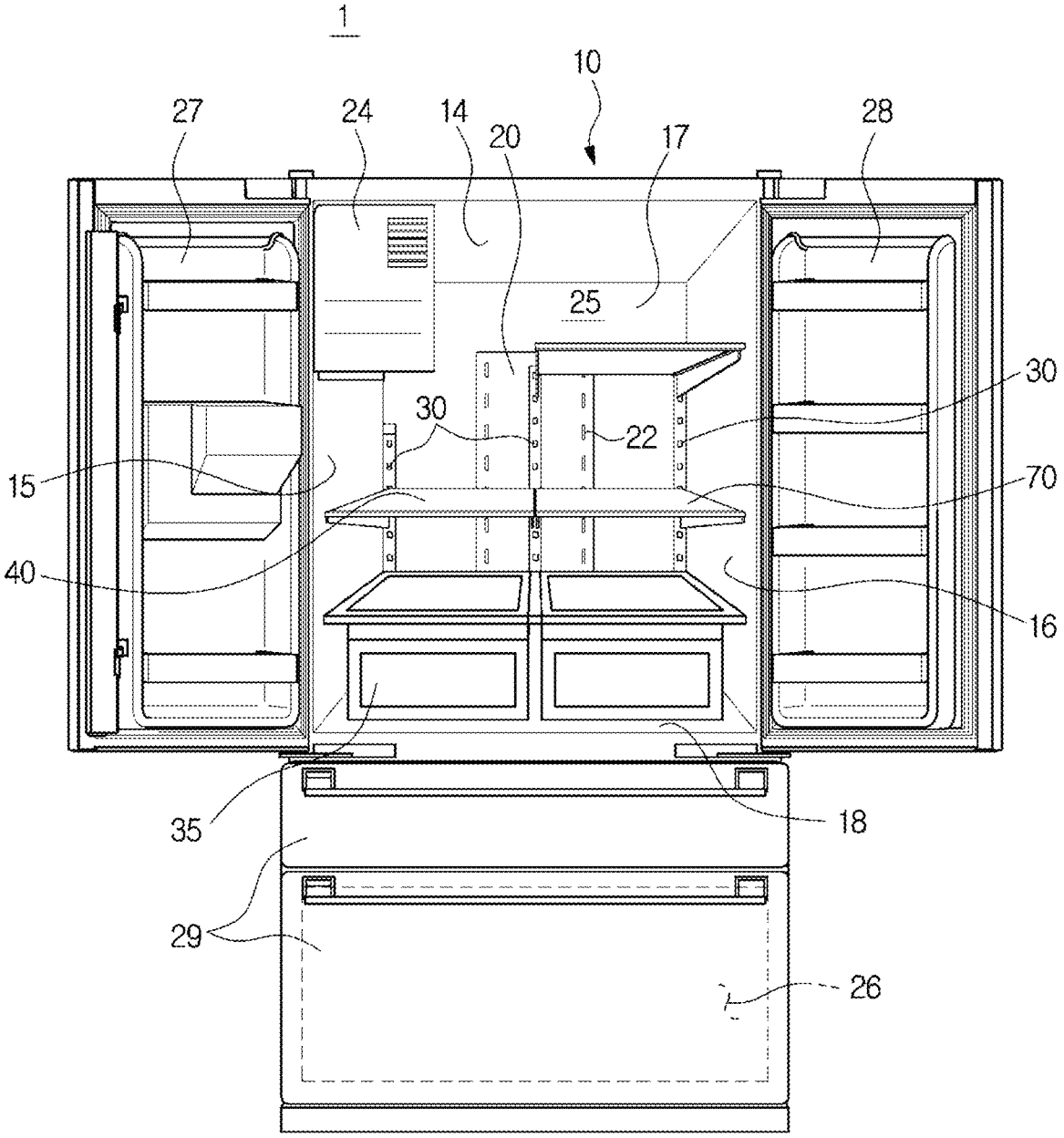
FIG. 1 illustrates a front view of a refrigerator according to an embodiment of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Reference will now be made in detail to the embodiments of the present disclosure, examples of which are illustrated in the accompanying drawings, wherein like reference numerals refer to like elements throughout. It is to be understood that both the foregoing general description and the following detailed description of the present disclosure are exemplary and explanatory and are intended to provide further explanation of the invention as claimed, and it is to be understood that various equivalents or modifications that may be substituted in the present application are intended to be included within the scope of the present disclosure.

The terms used in the present application are merely used to describe specific embodiments and are not intended to limit the present disclosure. A singular expression may include a plural expression unless otherwise stated in the context. The same reference numbers or symbols disclosed in the drawings of the present disclosure may represent parts or components which perform substantially the same function.

In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component.

A refrigerator according to the embodiments of the present disclosure will hereinafter be described with reference to the attached drawings.

Figure 2:
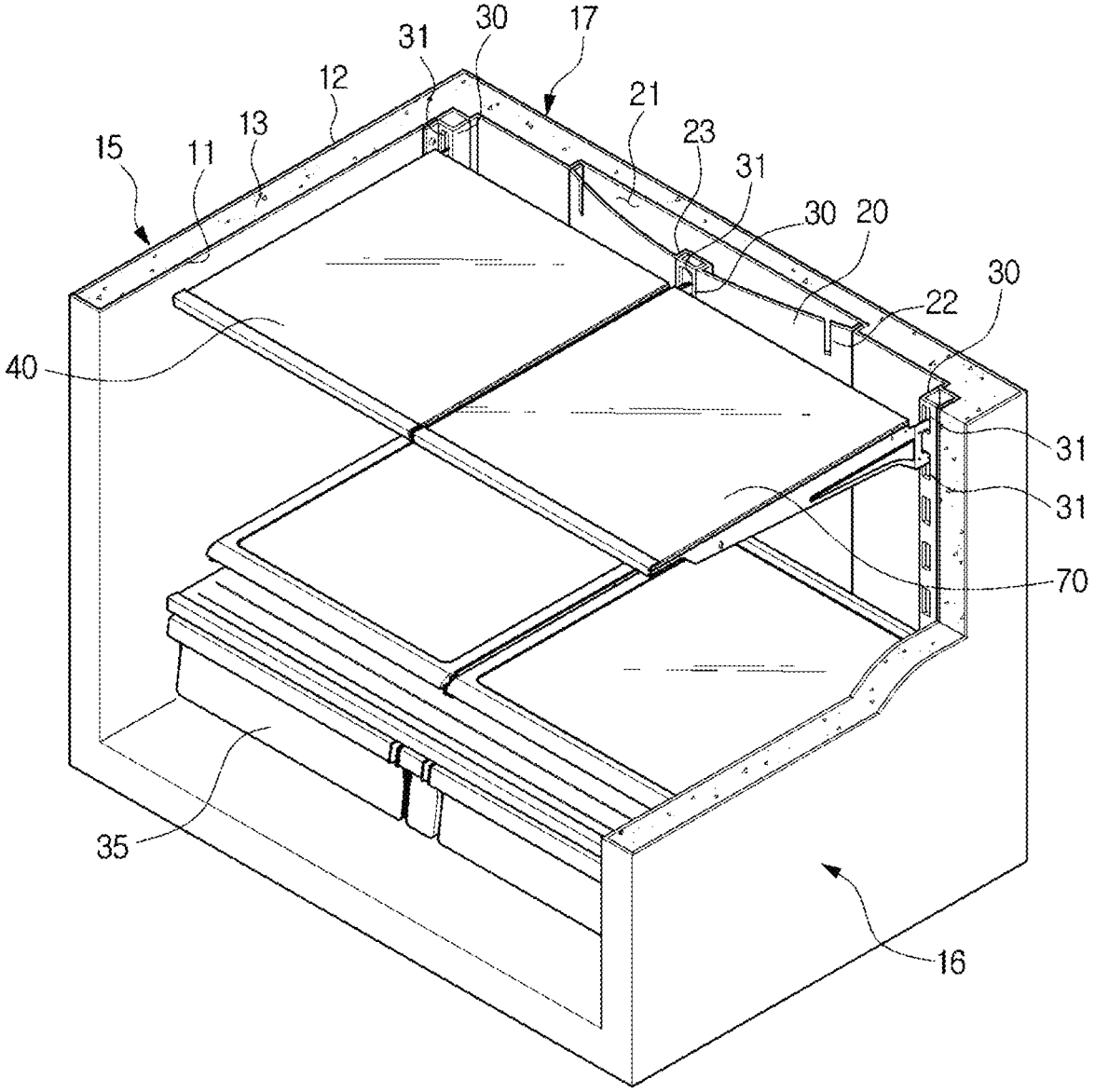
FIG. 2 illustrates a perspective view of a coupling structure of at least one shelf according to an embodiment of the present disclosure.

FIG. 1 illustrates a front view of a refrigerator 1 according to an embodiment of the present disclosure. FIG. 2 illustrates a perspective view of a coupling structure of at least one shelf according to an embodiment of the present disclosure.

Referring to FIGS. 1 and 2, the refrigerator 1 may include a main body 10 having storage chambers 25 and 26, doors 27, 28, and 29 provided to open or close the storage chambers 25 and 26, and a cold air supply device to supply cool air to the storage chambers 25 and 26. The cold air supply device may include an evaporator, a compressor, a condenser, and an expansion device, and may generate cool air using evaporation latent heat of refrigerant.

The main body 10 may include an inner casing 11 forming the storage chambers 25 and 26, an outer casing 12 coupled to an outer side of the inner casing 12 to form an outer appearance of the main body 10, and an insulation material 13 provided between the inner casing 11 and the outer casing 12. In another aspect, the main body 10 may include an upper wall 14, a lower wall, a left wall 15, a right wall 16, a rear wall 17, and an intermediate wall 18.

The storage chambers 25 and 26 may be divided into an upper storage chamber 25 and a lower storage chamber 26 by the intermediate wall 18. Indoor air temperature of the upper storage chamber 25 may be maintained at a temperature of about 0° C. to 5° C. such that the upper storage chamber 25 may be used as a refrigerating chamber to store food in a refrigerating mode. Indoor air temperature of the lower storage chamber 26 may be maintained at a temperature of about 30° C. to 0° C. such that the lower storage chamber 26 may be used as a freezing chamber to store food in a freezing mode.

Each of the storage chambers 25 and 26 may have an open front surface through which food is introduced into or removed from the storage chamber. The storage chambers 25 and 26 may be opened or closed by doors 27, 28, and 29. The upper storage chamber 25 may be opened or closed by one pair of rotary doors 27 and 28 rotatably coupled to the main body 10, and the lower storage chamber 26 may be opened or closed by a drawer door 29 to be slidably inserted or drawn. An ice maker 24 for making ice may be provided in the storage chamber 25.

The storage chamber 25 may include shelves 40 and 70 allowing food to be placed thereon, and a sealed container 35 to store food in a sealed state. The shelf support portion 30 supporting the shelves 40 and 70 may be provided at a rear side of the storage chamber 25, and the shelves 40 and 70 may be coupled to the shelf support portion 30 such that the shelves 40 and 70 may be supported by the shelf support portion 30. In more detail, a rear end of each of the shelves 40 and 70 may be coupled to the shelf support portion 30, and may be supported by the shelf support portion 30. A front end of each of the shelves 40 and 70 may be maintained in a non-fixed state. In other words, the shelves 40 and 70 may be coupled to the shelf support portion 30 provided at the rear of the storage chamber 25 in a cantilever manner, such that the shelves 40 and 70 may be supported by the shelf support portion 30.

The shelf support portion 30 may be installed at the rear wall 17 of the main body 10 and/or at a duct cover 20. The duct cover 20 forming a cold-air passage 21 through which cool air is supplied to the storage chamber 25 may be installed at the rear wall 17. Cool air formed by the cold air supply device may be supplied to the storage chamber 25 through the cold-air passage 21. The cold-air passage 21 may be formed between the duct cover 20 and the rear wall 17. A plurality of discharge holes 22 through which cool air from the cold-air passage 21 is supplied to the storage chamber 25 may be formed in the duct cover 20. A mounting groove 23 in which the shelf support portion 30 is installed may be formed in the duct cover 20.

A plurality of shelf hanger grooves 31 coupled to the shelves 40 and 70 may be formed in the shelf support portion 30. The plurality of shelf hanger grooves 31 may be provided in a vertical direction. The shelves 40 and 70 may be selectively coupled to a specific shelf hanger groove 31 from among the plurality of shelf hanger grooves 31. Accordingly, the height of each shelf 40 or 70 may be changed.

The shelves 40 and 70 may be arranged next to each other. The shelves 40 and 70 may be tilted by the weight of foods placed on the shelves 40 and 70, such that a height difference between the shelves 40 and 70 may occur. In addition, a height difference between the shelves 40 and 70 may occur either by errors in a fabrication process of the shelves 40 and 70 or the shelf support portion 30 or by errors in an assembly process of the shelves 40 and 70 and the shelf support portion 30. An adjustment member 100 (see FIG. 4) may be coupled to the shelves 40 and 70 so as to remove a height difference between the shelves 40 and 70. Detailed configurations of the shelves 40 and 70 and the adjustment member 100 will hereinafter be described with reference to the attached drawings.

Figure 3:
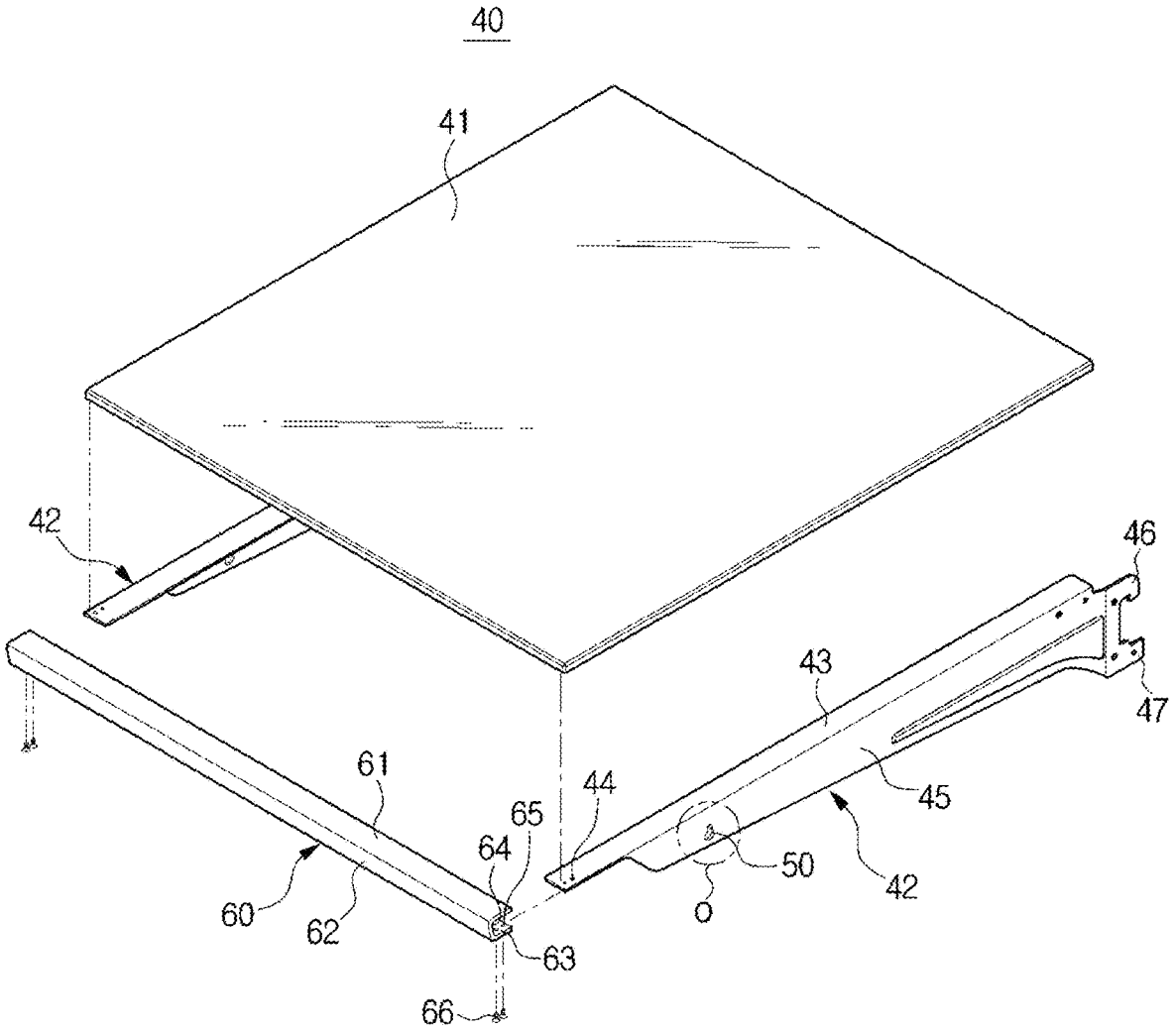
FIG. 3 illustrates an exploded perspective view of a shelf according to an embodiment of the present disclosure.
Figure 4:
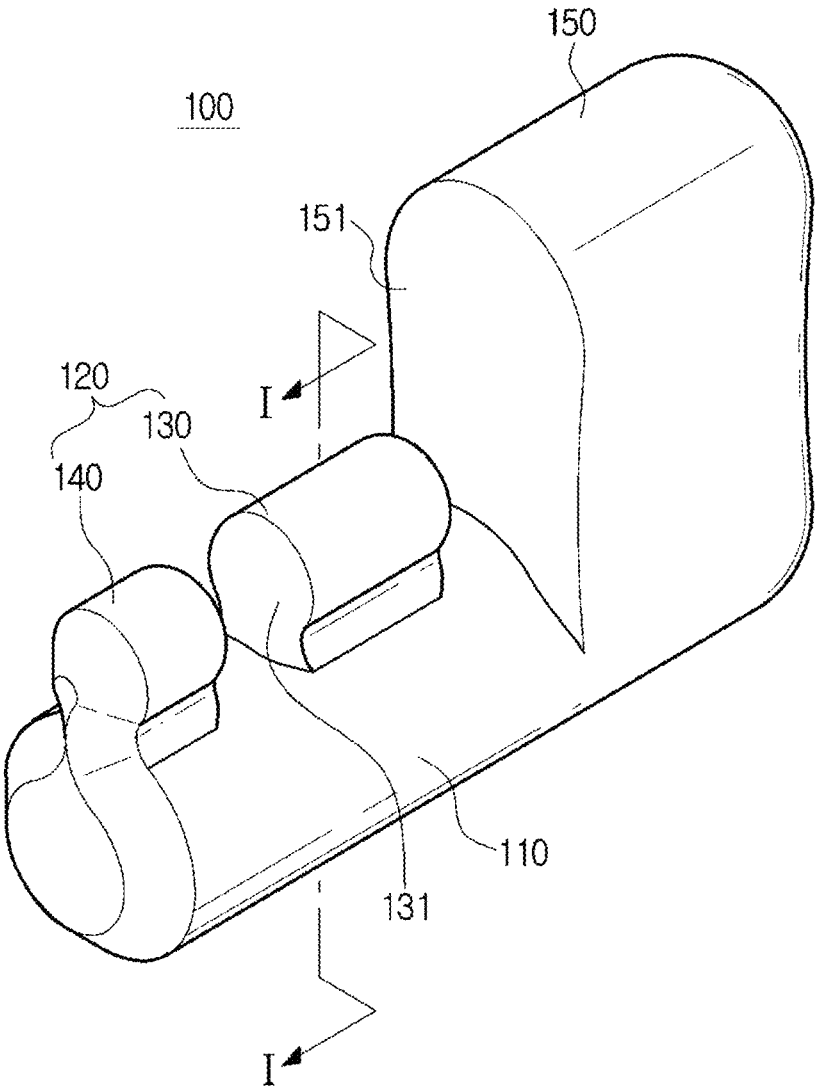
FIG. 4 illustrates a perspective view of an adjustment member according to an embodiment of the present disclosure.
Figure 5:
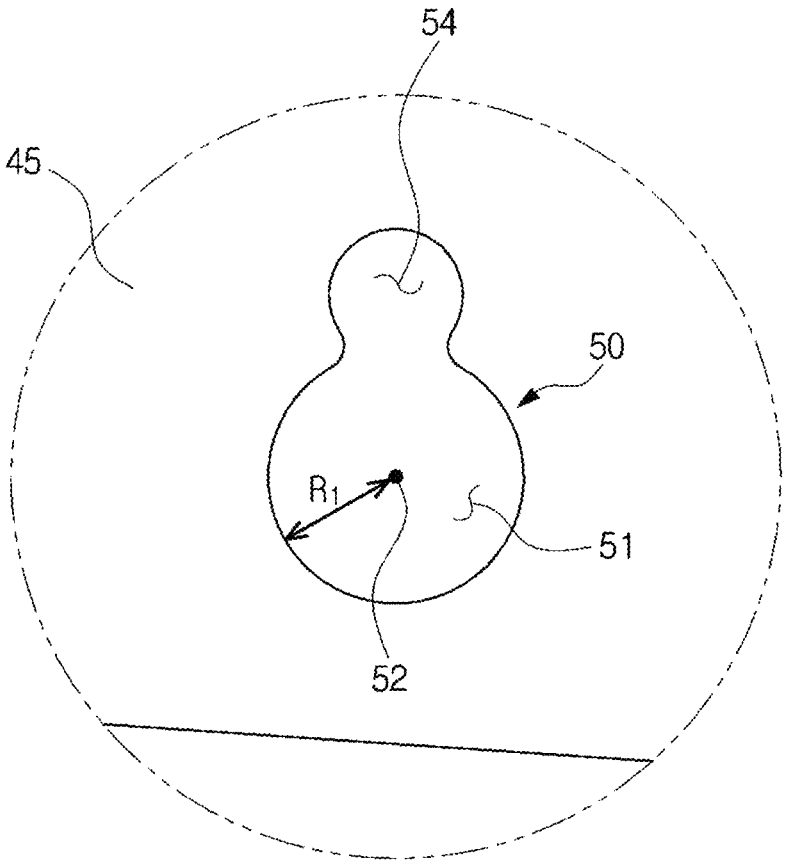
FIG. 5 illustrates an enlarged view of a specific part "O" of FIG. 3.
Figure 6:
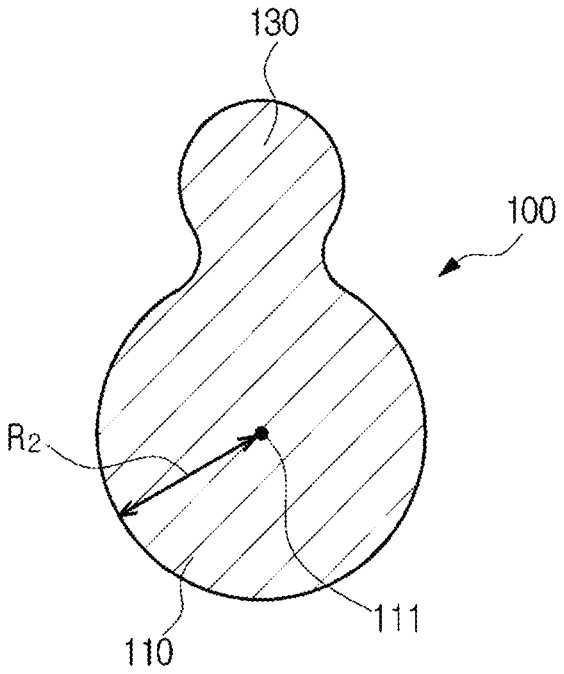
FIG. 6 illustrates a cross-sectional view of the line I-I shown in FIG. 4.
Figure 7:
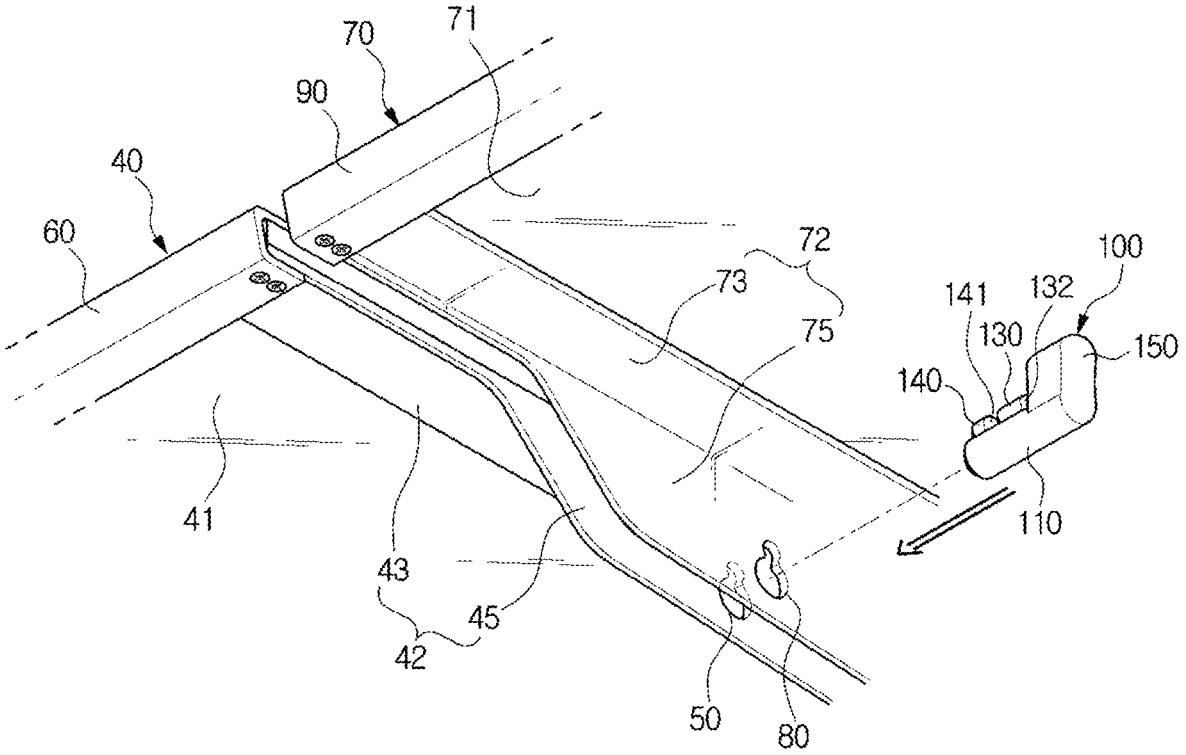
FIGS. 7 to 9 illustrate perspective views of operations for coupling the adjustment member to the plurality of shelves according to an embodiment of the present disclosure.
Figure 8:
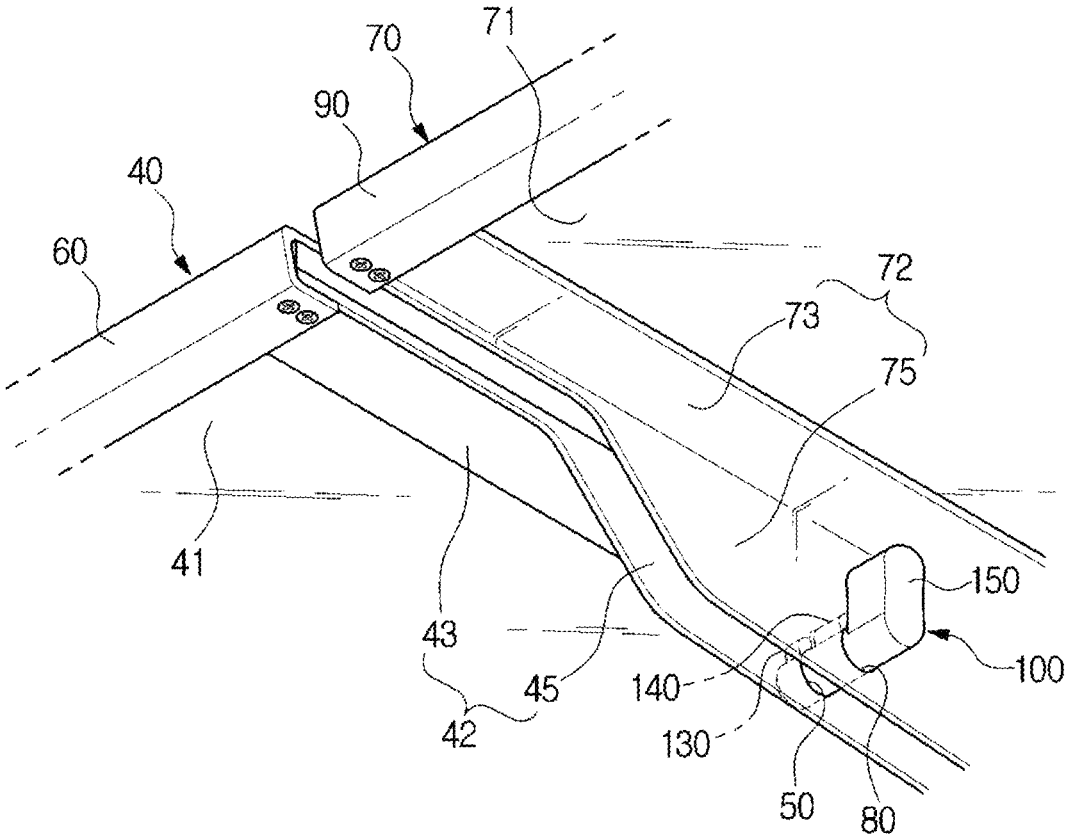
Figure 9:
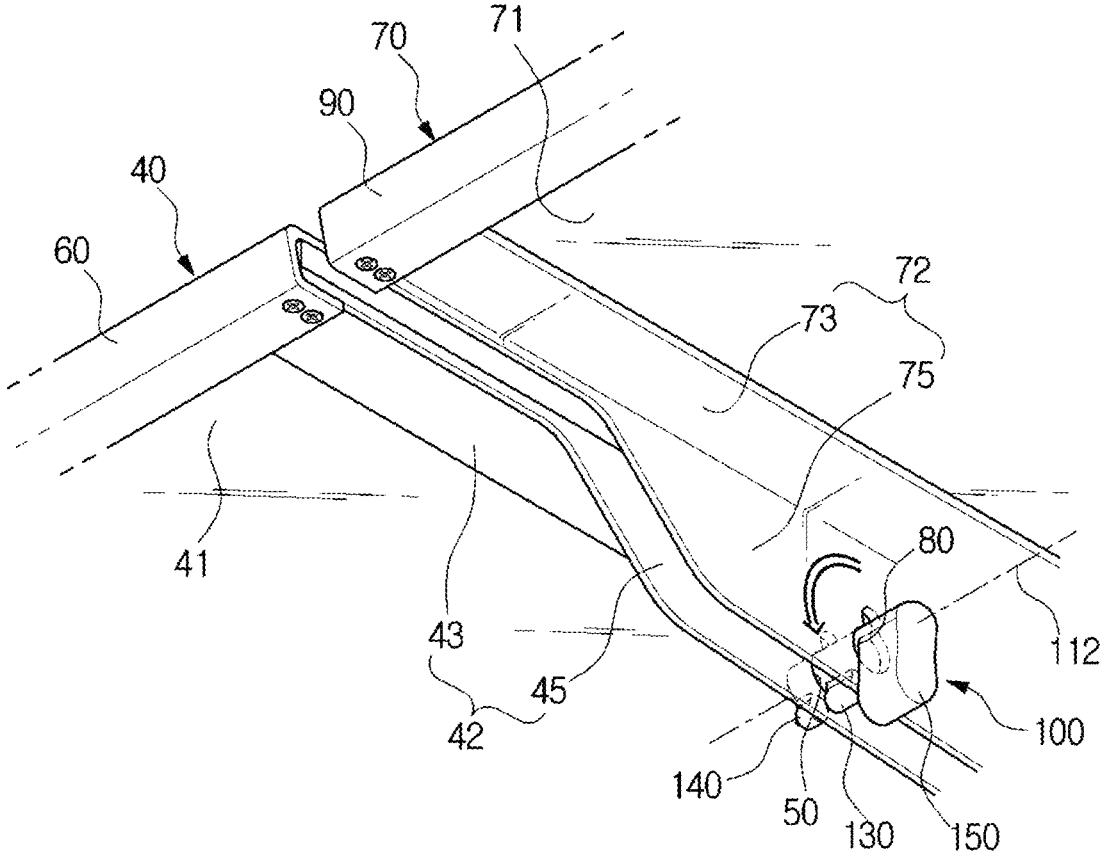
Figure 10:
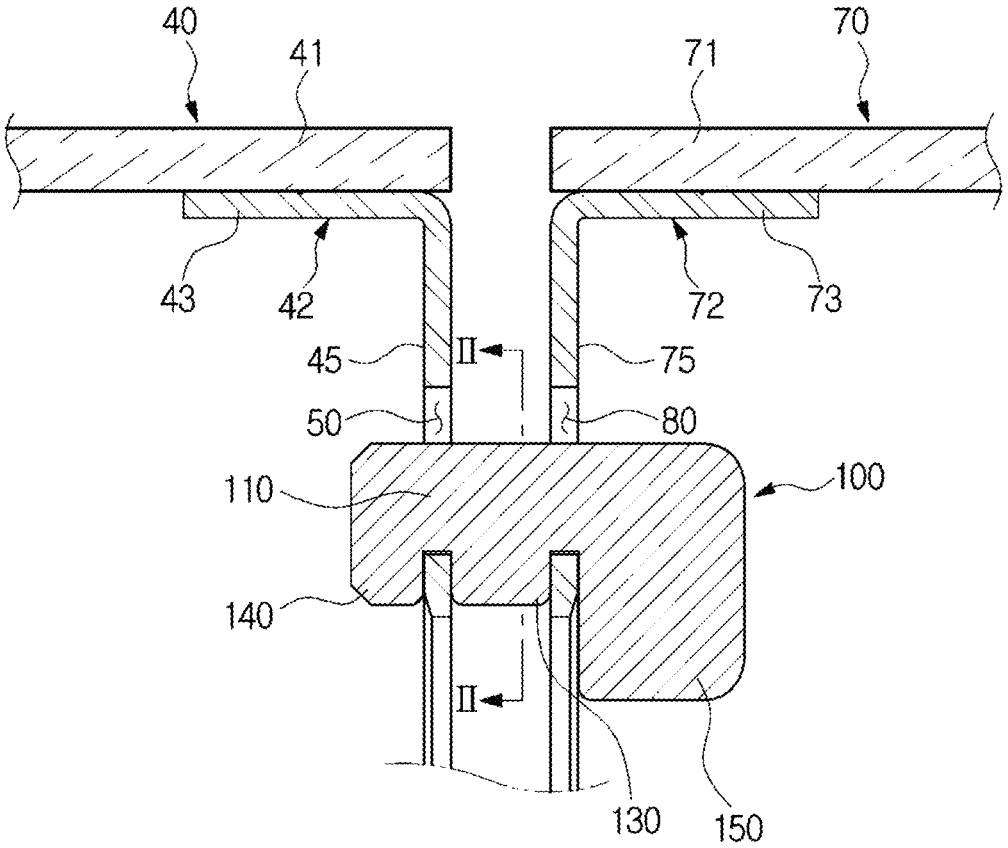
FIG. 10 illustrates a cross-sectional view of a fixed state of the adjustment member of FIG. 9.
Figure 11:
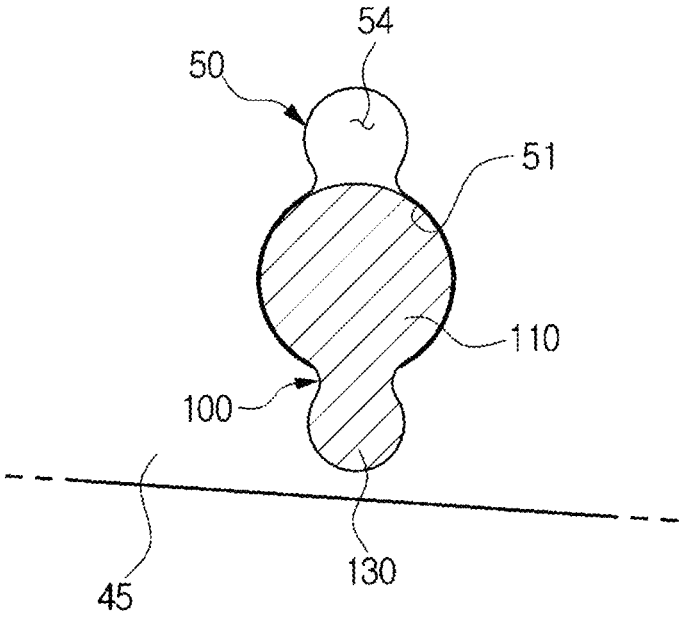
FIG. 11 illustrates a cross-sectional view of the line II-II shown in FIG. 10.

FIG. 3 illustrates an exploded perspective view of a shelf according to an embodiment of the present disclosure. FIG. 4 illustrates a perspective view of an adjustment member according to an embodiment of the present disclosure. FIG. 5 illustrates an enlarged view of a specific part "O" of FIG. 3. FIG. 6 illustrates a cross-sectional view of the line I-I shown in FIG. 4. FIGS. 7 to 9 illustrate perspective views of operations for coupling the adjustment member to the plurality of shelves according to an embodiment of the present disclosure. FIG. 10 illustrates a cross-sectional view of a fixed state of the adjustment member of FIG. 9. FIG. 11 illustrates a cross-sectional view of the line II-II shown in FIG. 10.

Referring to FIG. 3, the shelves 40 and 70 may be configured to correspond to each other. Therefore, only one shelf 40 will hereinafter be described, and a detailed description of the other one shelf 70 will herein be omitted for convenience of description. The shelf 40 may include a shelf plate 41 allowing food to be placed thereon, and at least one hanger 42 coupled to the shelf plate 41 to support the shelf plate 41. The hangers 42 may be respectively coupled to a left side and a right side of the shelf plate 41. The left hanger and the right hanger may be configured to correspond to each other. The shelf plate 41 and the hangers 42 may be coupled to each other in various ways. For example, the shelf plate 41 and each hanger 42 may be coupled to each other by an adhesive member, or may be coupled to each other by a fastening member such as a screw, a pin, etc. The shelf plate 41 may be formed of a glass material, and each of the hangers 42 may be formed of a plastic or metal material.

The shelf 40 may further include a frame 60 coupled to a front end of the shelf plate 41. The frame 60 may protect the front end of the shelf plate 41, and may enhance coupling force between the shelf plate 41 and each hanger 42. The frame 60 may be formed in a "⊏" shape. In other words, the frame 60 may include an upper support portion 61, a front support portion 62, and a lower support portion 63. A receiver groove 64 may be formed among the upper support portion 61, the front support portion 62, and the lower support portion 63. The shelf plate 41 and each hanger 42 may be inserted into the receiver groove 64, such that the shelf plate 41 and the hanger 42 may be coupled to the receiver groove 64. At least one fastening hole 65 may be formed in the lower support portion 63. The fastening member 65 may be coupled to at least one fastening hole 44 of the hanger 42 and at least one fastening hole 65 of the lower support portion 63.

Each of the hangers 42 may include a horizontal portion 43 formed parallel to the shelf plate 41, and a vertical portion 45 extending downward from the horizontal portion 43, thereby supporting the shelf plate 41. The vertical portion 45 may be formed perpendicular to the horizontal portion 43. The vertical portion 45 may include a coupling hole 50 connected to the adjustment member 100.

Each hanger 42 may include coupling protrusions 46 and 47 coupled to the shelf support portion 30. The coupling protrusions 46 and 47 may be formed at a rear end of the vertical portion 45. The coupling protrusions 46 and 47 may be formed in a vertical direction. That is, one coupling protrusion 47 may be formed under the other coupling protrusion 46. The coupling protrusions 46 and 47 may be respectively inserted into the shelf hanger grooves 31 of the shelf support portion 30. In order to prevent the hangers 42 from being separated from the shelf support portion 30, the upper coupling protrusion 46 from among the coupling protrusions 46 and 47 may be formed in a hook shape.

Referring to FIG. 5, the coupling hole 50 may include a center region 51 formed in a circular shape having a center point and a radius R1, and a guide region 54 formed to extend in a radial outward direction from the center region 51. The shape of the guide region 54 is not limited thereto, and the guide region 54 may be formed seamlessly in the radial outward direction from the center region 51.

Referring to FIG. 7, the shelf 70 arranged next to the shelf 40 may include a shelf plate 71 allowing food to be placed thereon, a hanger 72 coupled to the shelf support portion 30 to support the shelf plate 71, and a frame 90 coupled to a front end of the shelf support portion 71 to protect the front end of the shelf plate 71 as well as to enhance coupling force of the hanger 72.

The hanger 72 may include a horizontal portion 73 formed parallel to the shelf plate 71 and a vertical portion 75 formed to extend downward from the horizontal portion 73. A coupling hole 80 coupled to the adjustment member 100 may be formed in the vertical portion 75. The coupling hole 80 may be formed to correspond to the coupling hole 50.

The adjustment member 100 may be coupled to the coupling holes 50 and 80 of the shelves 40 and 70 so as to remove a height difference between the shelves 40 and 70, as shown in FIG. 7. For convenience of description, the left one of the shelves 40 and 70 will hereinafter be referred to as a first shelf 40, and the right one of the shelves 40 and 70 will hereinafter be referred to as a second shelf 70.

Referring to FIGS. 4 to 7, the adjustment member 100 may include a rod portion 110 elongated to be inserted into the coupling hole 50 of the first shelf 40 and the coupling hole 80 of the second shelf 70, and a stopper portion 120 formed to protrude from the rod portion 110.

The rod portion 110 may be formed in a substantially cylindrical shape, and may have a cross-sectional region corresponding to a shape and size of the center region 51 such that the rod portion 110 can be inserted into the center region 51. In other words, as shown in FIG. 6, the rod portion 110 may have a circular cross-sectional region having a center point 111 and a radius R2. The radius R2 may correspond to the radius R1. That is, the radius R2 may be substantially identical to the radius R1.

The stopper portion 120 may be formed to extend in the radial outward direction from the rod portion 110. The stopper portion 120 may have a cross-sectional region corresponding to the shape and size of the guide region 54 such that the stopper portion 120 can be inserted into the guide region 54.

The stopper portion 120 may include a center stopper 130 and an auxiliary stopper 140 that are spaced apart from each other by a predetermined distance. A cross-sectional region of the center stopper 130 may be identical in shape and size to a cross-sectional region of the auxiliary stopper 140, and the center stopper 130 and the auxiliary stopper 140 may protrude in the same direction.

When the adjustment member 100 is fixed to the shelves 40 and 70, the center stopper 130 may be caught between the shelves 40 and 70. In more detail, the center stopper 130 may be provided to be caught between the vertical portion 45 of the first shelf 40 and the vertical portion 75 of the second shelf 70. The center stopper 130 may include a support surface 131 provided to be caught by the vertical portion 45 of the first shelf 40, and a support surface 132 provided to be caught by the vertical portion 75 of the second shelf 70.

The auxiliary stopper 140 may be provided to be caught by one shelf 40 from among the shelves 40 and 70. In more detail, the auxiliary stopper 140 may include a support surface 141 provided to be caught by the vertical portion 45 of the first shelf 40.

The adjustment member 100 may include a grip portion 150 formed to protrude in a radial outward direction from the rod portion 110 such that the grip portion 150 can be grasped by a user hand. The grip portion 150 may be spaced apart from the center stopper 130. The grip portion 150 may be formed at an opposite side of the auxiliary stopper 140 with respect to the center stopper 130. The grip portion 150 may be larger than the stopper portion 120 such that the user can easily grasp the grip portion 150 by hand.

When the adjustment member 100 is inserted into the coupling hole 50 of the first shelf 40 and the coupling hole 80 of the second shelf 70, the grip portion 150 may restrict the insertion depth of the adjustment member 100. That is, when the adjustment member 100 is inserted into the coupling hole 50 of the first shelf 40 and the coupling hole 80 of the second shelf 70, the grip portion 150 may be caught by the vertical portion 75 of the second shelf 70. The grip portion 150 may include a support surface 151 provided to be caught by the vertical portion 75 of the second shelf 70.

The operation of coupling the adjustment member 100 to the shelves 40 and 70 according to the embodiment of the present disclosure will hereinafter be described with reference to FIGS. 7 to 10.

Referring to FIG. 7, the adjustment member 100 may be inserted into the coupling hole 80 of the second shelf 70 and the coupling hole 50 of the first shelf 40 in a state in which the first shelf 40 and the second shelf 70 are coupled to the shelf support portion 30. The rod portion 110 may adjust the position of the adjustment member 100 in a manner that the rod portion 110 can pass through the center region 51 of the coupling holes 80 and 50, and the auxiliary stopper 140 and the center stopper 130 can pass through the guide region 54 of the coupling holes 80 and 50, and at the same time may insert the adjustment member 100 into the coupling holes 80 and 50. The adjustment member 100 may be inserted in a longitudinal direction of the rod portion 110.

Referring to FIG. 8, when the adjustment member 100 is inserted into the coupling holes 80 and 50, the grip portion 100 may be caught by the second shelf 70, and the insertion length of the adjustment member 100 may be restricted. In this case, the position of the adjustment member 100 may be referred to as a provisionally fixed position.

When the adjustment member 100 is located at the provisionally fixed position, the center stopper 130 may be located between the vertical portion 45 of the first shelf 40 and the vertical shelf 75 of the second shelf 70. When the adjustment member 100 is located at the provisionally fixed position, it should be noted that the center stopper 130 and the auxiliary stopper 140 are not caught by the shelves 40 and 70. Accordingly, when the adjustment member 100 is located at the provisionally fixed position, the adjustment member 100 may be separated in a direction opposite to the insertion direction.

Referring to FIGS. 9 and 10, the adjustment member 100 in the provisionally fixed position may rotate by a predetermined angle with respect to a longitudinal central axis 112 of the adjustment member 100. During rotation of the adjustment member 100, the center stopper 130 may be caught by the vertical portion 45 of the first shelf 40 and the vertical portion 75 of the second shelf 70, and the auxiliary stopper 140 may be caught by the vertical portion 45 of the first shelf 40. In this case, the position of the adjustment member 100 will hereinafter be referred to as a fixed position. When the adjustment member 100 is located at the fixed position, the adjustment member 100 may be prevented from being separated in a direction opposite to the insertion direction.

In another aspect, when the adjustment member 100 is located at the fixed position, the vertical portion 45 of the first shelf 40 may be fixed while being inserted between the auxiliary stopper 140 and the center stopper 130, and the vertical portion 75 of the second shelf 70 may be fixed while being inserted between the center stopper 130 and the grip portion 150.

As described above, according to the embodiment of the present disclosure, since the adjustment member 100 is inserted into the coupling holes 50 and 80 of the shelves 40 and 70 and then rotates by a predetermined angle, the adjustment member 100 may be fixed to the shelves 40 and 70.

When the adjustment member 100 is fixed, the adjustment member 100 can be prevented from being separated in the insertion direction or in an opposite direction to the insertion direction. Therefore, the shelves 40 and 70 can be prevented from moving relative to each other. As a result, the adjustment member 100 may remove the height difference between the shelves 40 and 70, such that a gap between the shelves 40 and 70 can be maintained constant such that the gap between the shelves 40 and 70 is prevented from being increased or reduced.

In addition, when the user desires to fix the adjustment member 100, the user may insert the adjustment member 100 into the coupling holes 50 and 80 of the shelves 40 and 70 and then rotates the adjustment member 100, such that the adjustment member 100 can be fixed. In contrast, when the user desires to separate the adjustment member 100 from the coupling holes 50 and 80 of the shelves 40 and 70, the adjustment member 100 rotates in a direction opposite to the above fixing direction and is then taken out from the coupling holes 50 and 80 of the shelves 40 and 70, such that the adjustment member 100 can be separated, resulting in increased user convenience.

Figure 12:
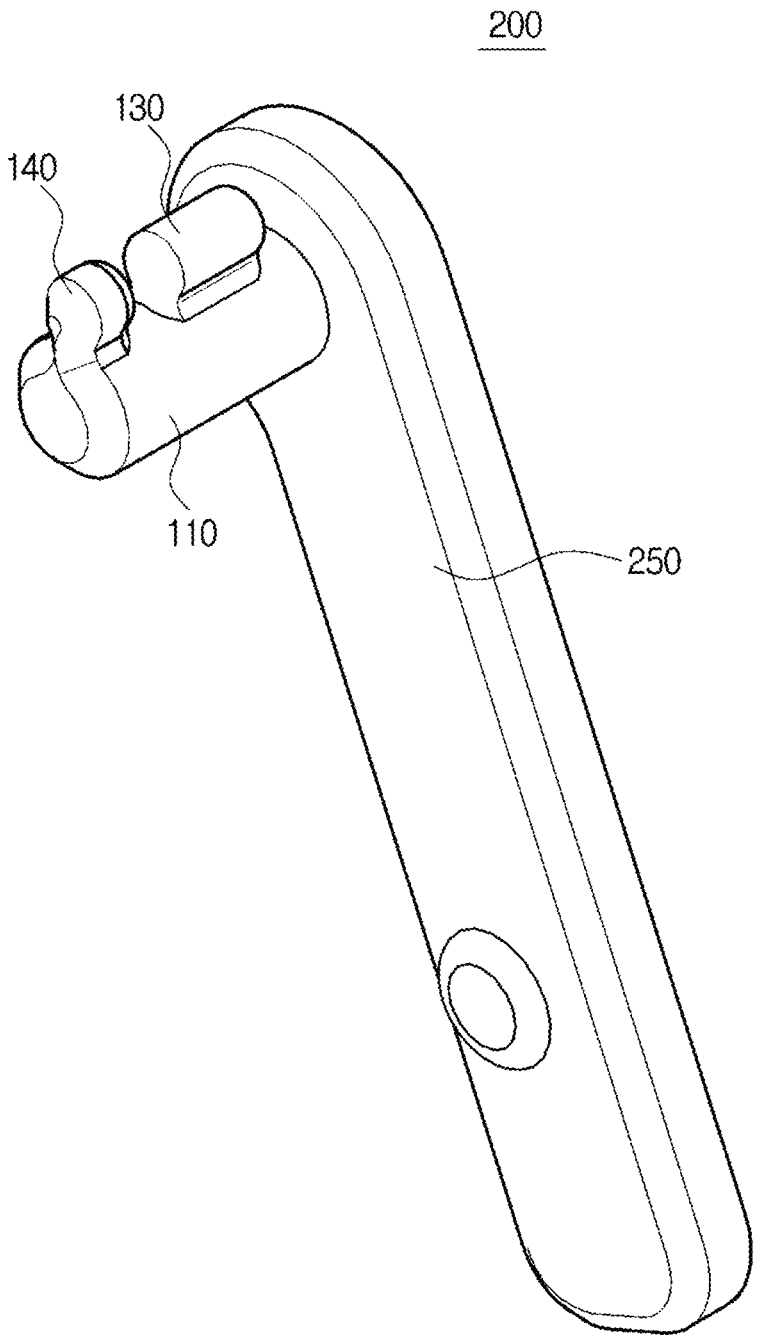
FIG. 12 illustrates a perspective view of an adjustment member according to another embodiment of the present disclosure.

FIG. 12 illustrates a perspective view of an adjustment member 200 according to another embodiment of the present disclosure.

The adjustment member 200 according to another embodiment of the present disclosure will hereinafter be described with reference to FIG. 12. The same reference numbers may be used throughout the drawings to refer to the same or like portions, and as such a detailed description thereof will herein be omitted for convenience of description.

As compared to the adjustment member 100 disclosed in the above-mentioned embodiment, a grip portion 250 of the adjustment member 200 shown in FIG. 12 may be extended longer than the grip portion 150 of the adjustment member 100. Whereas the grip portion 150 of the adjustment member 100 may protrude from an outer circumference of the rod portion 110 by 1~2 times a radius R1 of the rod portion 110, the grip portion 250 of the adjustment member 200 may protrude from the outer circumference of the rod portion by 5~10 times the radius R1 of the rod portion 110. As described above, as the grip portion 250 increases in length, the user can more easily grasp the grip portion 250 and can rotate the adjustment member 200 using less force.

Figure 13:
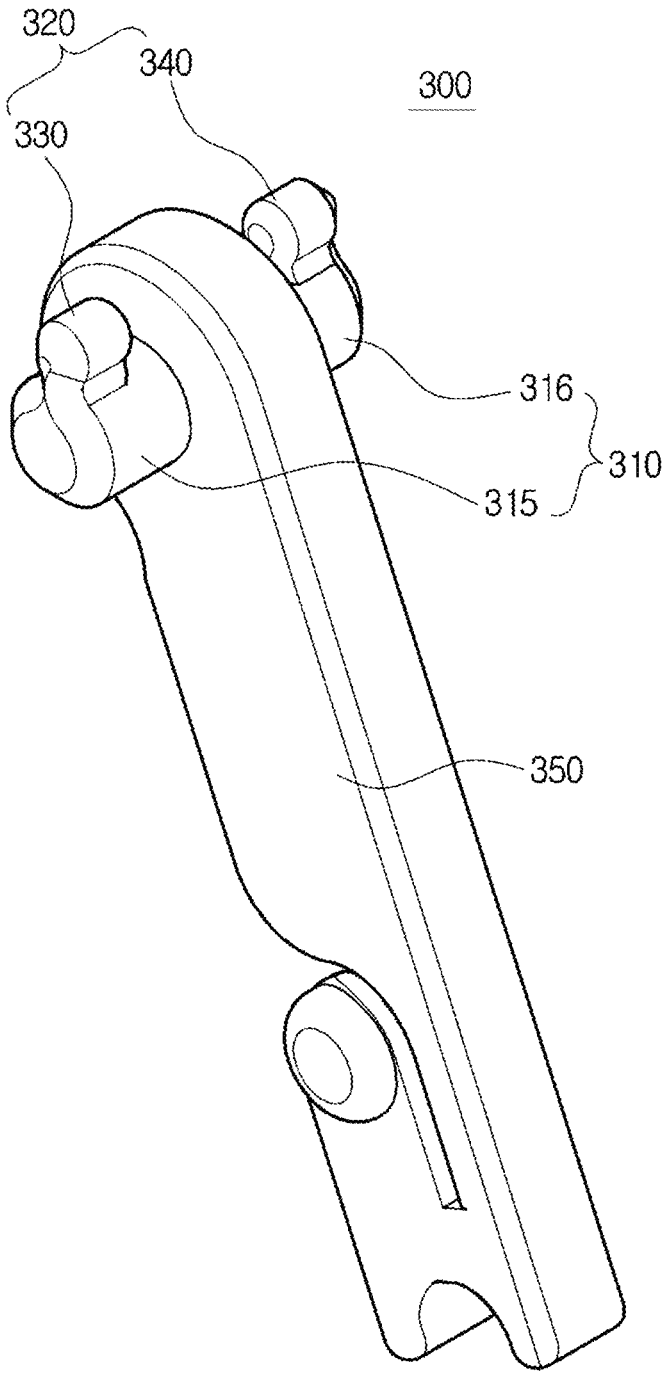
FIG. 13 illustrates a perspective view of an adjustment member according to still another embodiment of the present disclosure.
Figure 14:
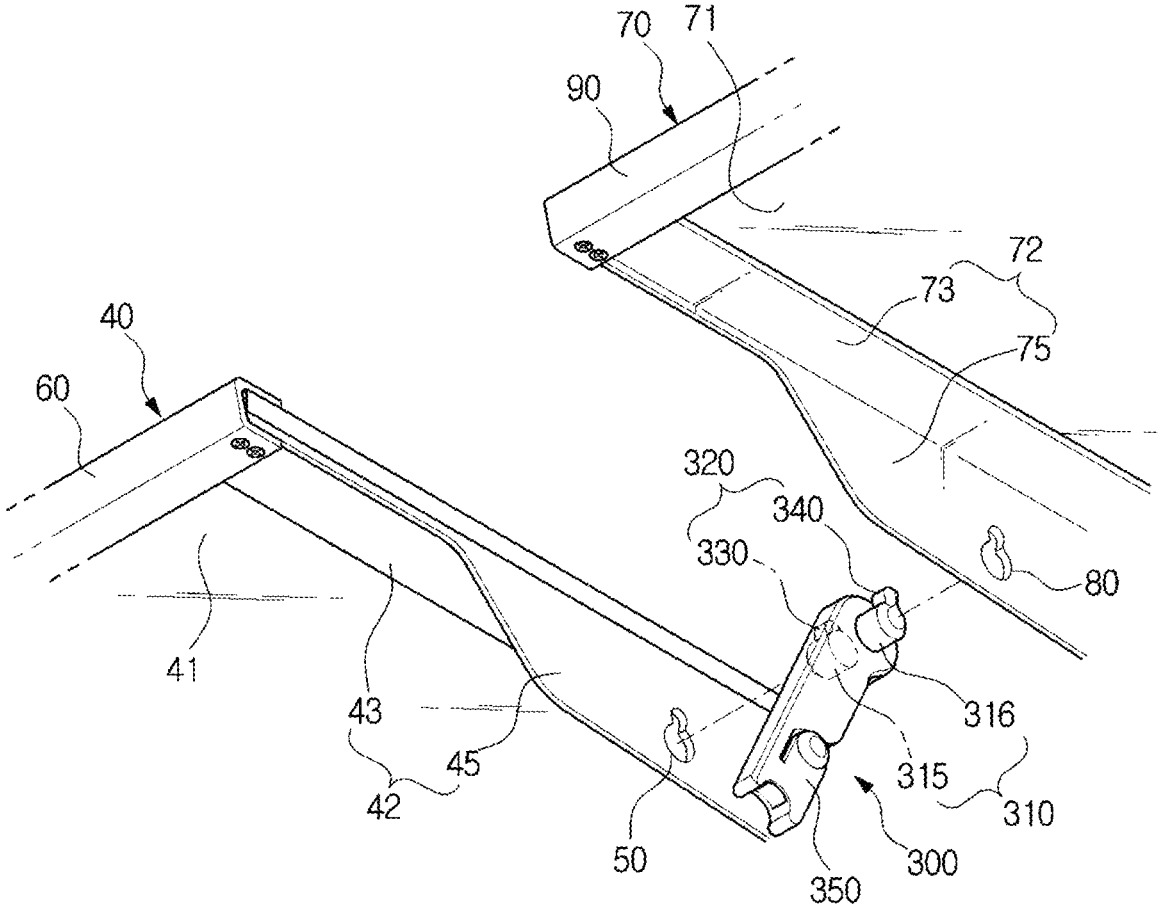
FIGS. 14 to 16 illustrate perspective views of operations for coupling the adjustment member to the plurality of shelves according to still another embodiment of the present disclosure.
Figure 15:
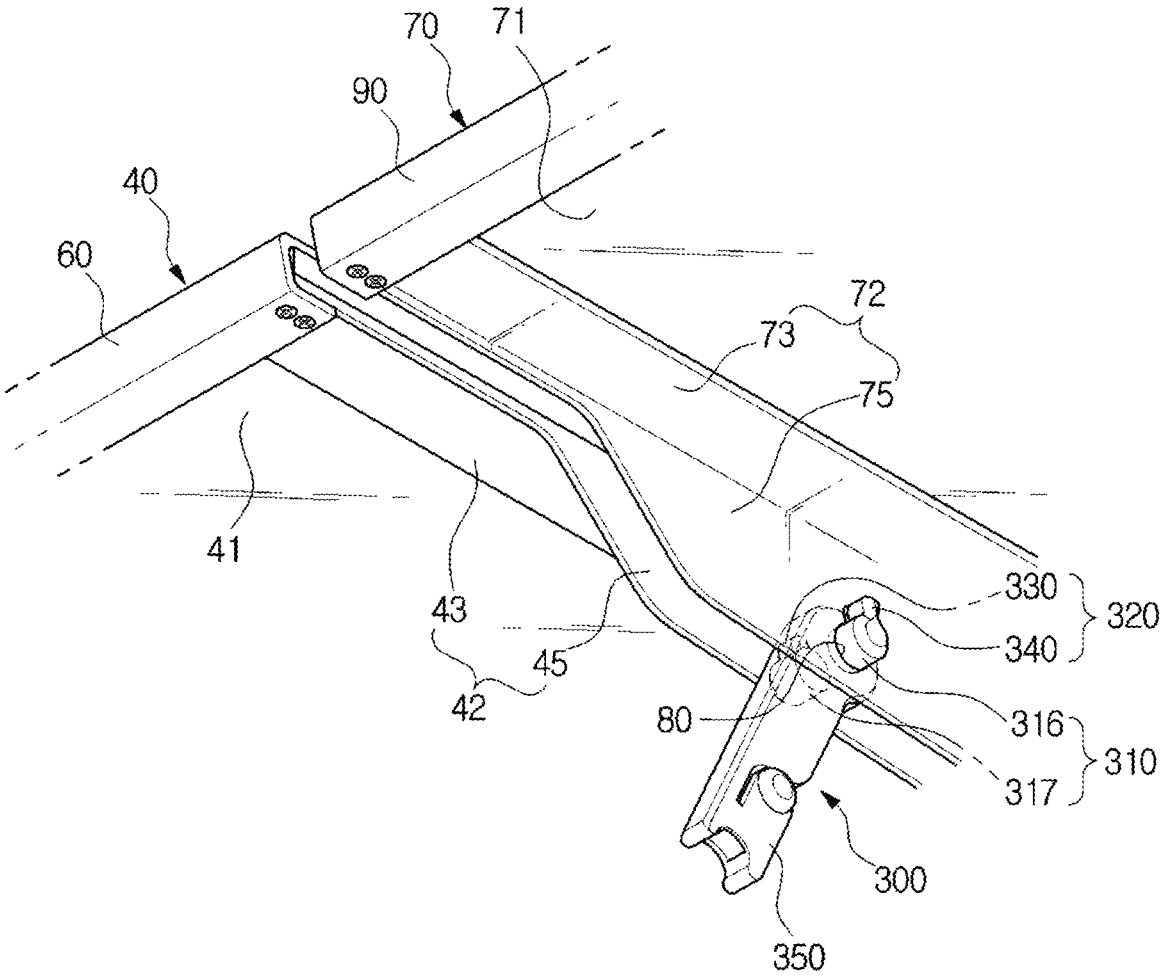
Figure 16:
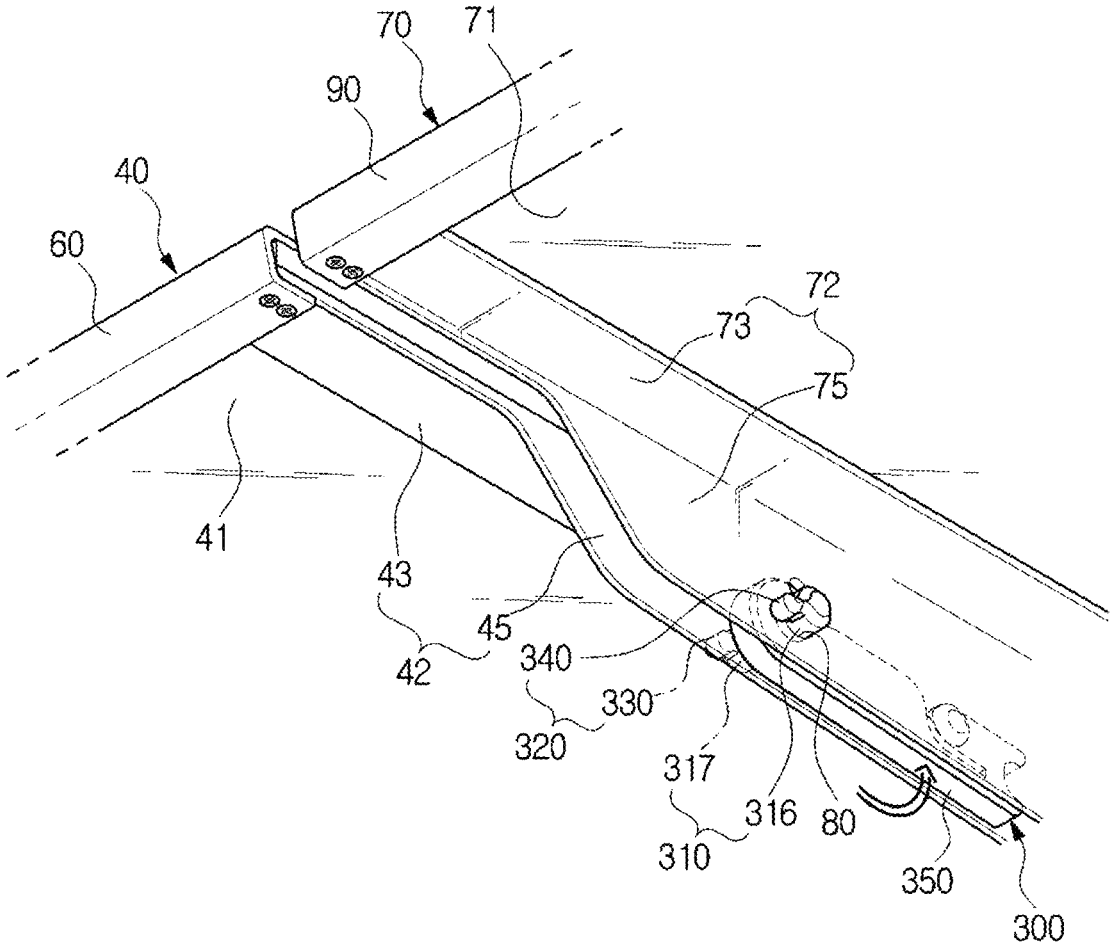
Figure 17:
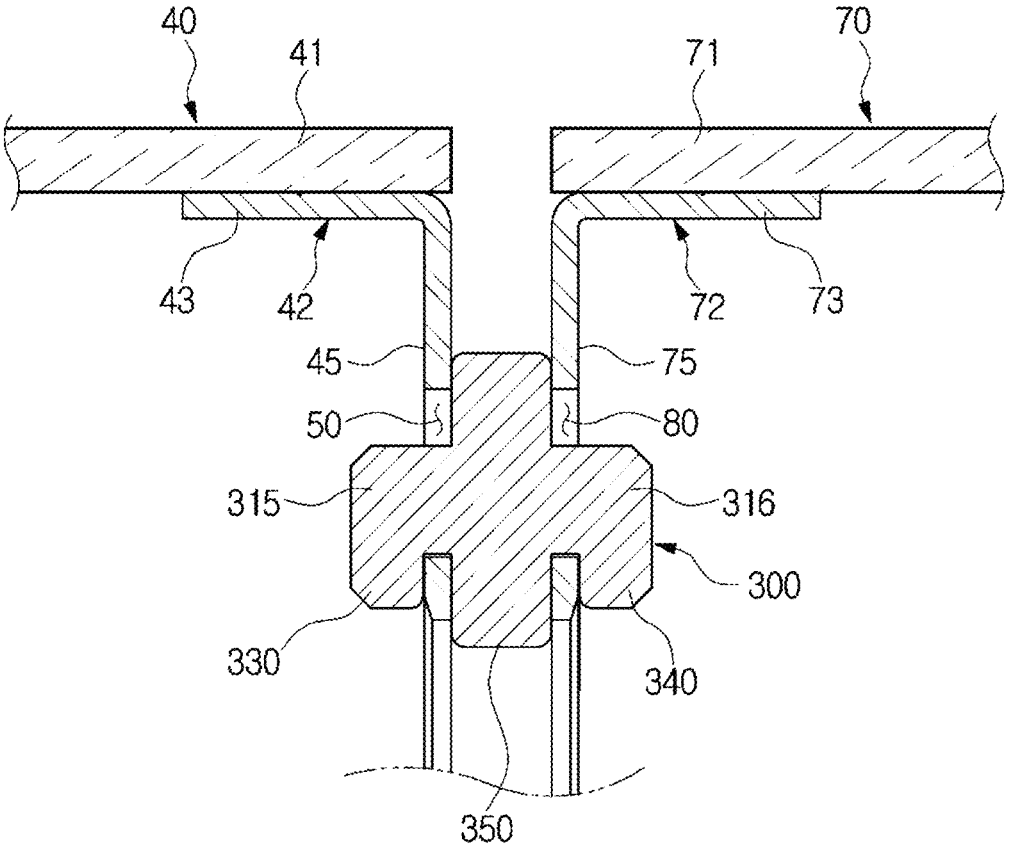
FIG. 17 illustrates a cross-sectional view of a fixed state of the adjustment member of FIG. 16.

FIG. 13 illustrates a perspective view of an adjustment member according to still another embodiment of the present disclosure. FIGS. 14 to 16 illustrate perspective views of operations for coupling the adjustment member to the plurality of shelves according to still another embodiment of the present disclosure. FIG. 17 illustrates a cross-sectional view of a fixed state of the adjustment member of FIG. 16.

The adjustment member 300 according to another embodiment of the present disclosure will hereinafter be described with reference to FIG. 13. The same reference numbers may be used throughout the drawings to refer to the same or like portions, and as such a detailed description thereof will herein be omitted for convenience of description.

The adjustment member 300 may include a cylindrical rod portion 310 extended to be inserted into the coupling hole 50 of the first shelf 40 and the coupling hole 80 of the second shelf 70, a grip portion 350 formed to protrude in the radial outward direction from the rod portion 310 so as to be grasped by a user hand, and a stopper portion 320 including two stoppers that are formed to protrude in the radial outward direction from the rod portion 310 and are respectively arranged at both sides of the grip portion 350 while being spaced apart from each other.

The rod portion 310 may include a first rod portion 315 and a second rod portion 316. The first rod portion 315 may be formed at one side of the grip portion 350, such that the first rod portion 315 may be inserted into the coupling hole 50 of the first shelf 40. The second rod portion 316 may be formed at an opposite side of the one side of the grip portion 350, such that the second rod portion 316 may be inserted into the coupling hole 80 of the second shelf 70.

The grip portion 350 may be formed at a substantially center part of the rod portion 310, and the first rod portion 315 may be substantially identical in length to the second rod portion 316. When the adjustment member 300 is inserted into the coupling hole 50 of the first shelf 40 and the coupling hole 80 of the second shelf 70, the grip portion 350 may restrict the insertion length of the adjustment member 300. In other words, when the adjustment member 300 is inserted into the coupling hole 40 of the first shelf 40, the grip portion 350 may be caught by the vertical portion 45 of the first shelf 40. When the adjustment member 300 is inserted into the coupling hole 80 of the second shelf 70, the grip portion 350 may be caught by the vertical portion 75 of the second shelf 70.

The stopper portion 320 may include a first lateral stopper 330 protruding from the first rod portion 315, and a second lateral stopper 340 protruding from the second rod portion 316. The first lateral stopper 330 may be caught by the vertical portion 45 of the first shelf 40, and the second lateral stopper 340 may be caught by the vertical portion 75 of the second shelf 70.

The operation for coupling the adjustment member 300 to the shelves 40 and 70 according to another embodiment of the present disclosure will hereinafter be described with reference to FIGS. 14 to 17.

Referring to FIG. 14, the adjustment member 300 may be inserted into the coupling hole 50 of the first shelf 40 and the coupling hole 80 of the second shelf in a state in which the first shelf 40 and the second shelf 70 are coupled to the shelf support portion 30. The rod portion 310 may adjust the position of the adjustment member 300 in a manner that the rod portion 300 can pass through the center region 51 of the coupling holes 50 and 80, and the stopper 320 can pass through the guide region 54 of the coupling holes 50 and 80, and at the same time may insert the adjustment member 300 into the coupling holes 50 and 80.

Referring to FIG. 15, when the adjustment member 300 is inserted into the coupling holes 50 and 80, the grip portion 350 may be caught by the first shelf 40 and the second shelf 70, and the insertion length of the adjustment member 300 may be restricted. In this case, the position of the adjustment member 300 may be referred to as a provisionally fixed position.

Referring to FIG. 16, the adjustment member 300 in the provisionally fixed position may rotate by a predetermined angle with respect to a longitudinal central axis of the adjustment member 300. During rotation of the adjustment member 300, the first lateral stopper 330 may be caught by the vertical portion 45 of the first shelf 40, and the second lateral stopper 340 may be caught by the vertical portion 75 of the second shelf 70. In this case, the position of the adjustment member 300 will hereinafter be referred to as a fixed position. When the adjustment member 300 is located at the fixed position, the adjustment member 300 may be prevented from being separated in a direction opposite to the insertion direction.

In another aspect, when the adjustment member 300 is located at the fixed position, the vertical portion 45 of the first shelf 40 may be fixed while being inserted between the first lateral stopper 340 and the grip portion 350, and the vertical portion 75 of the second shelf 70 may be fixed while being inserted between the grip portion 350 and the second lateral stopper 340.

As compared to the adjustment member 100 disclosed in the above-mentioned embodiment, when the adjustment member 300 is inserted into the coupling hole 50 of the first shelf 40 and the coupling hole 80 of the second shelf 70, the user has to further increase the spacing between the first shelf 40 and the second shelf 70, resulting in greater user inconvenience. However, when the adjustment member 300 is inserted into the coupling hole 50 of the first shelf 40 and the coupling hole 80 of the second shelf 70 and then rotates, the adjustment member 300 may be hidden in the spacing between the vertical portion 45 of the first shelf 40 and the vertical portion 75 of the second shelf 70, such that the adjustment member 300 may not be exposed outside.

As is apparent from the above description, the refrigerator having the adjustment member according to the embodiments of the present disclosure may prevent occurrence of a height difference between the plurality of shelves arranged next to each other.

The refrigerator having the adjustment member according to the embodiments of the present disclosure may include an adjustment member which maintains a constant interval between the plurality of shelves and prevents the shelves from moving relative to each other.

The refrigerator according to the embodiments of the present disclosure may include an adjustment member which is easily coupled to and separated from others, resulting in improved usability.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a main body;

a storage chamber formed in the main body;

a shelf support portion provided at a rear side of the storage chamber;

a plurality of shelves coupled to the shelf support portion so that the plurality of shelves is arranged next to each other; and an adjustment member coupled to the plurality of shelves to remove a height difference between the plurality of shelves, wherein:

a plurality of coupling grooves is formed in the plurality of shelves, the adjustment member is inserted into a plurality of coupling holes of the plurality of shelves and then rotates by a predetermined angle so that the adjustment member is fixed to the plurality of shelves, the adjustment member includes a rod portion formed in a cylindrical shape and extending to be inserted into the plurality of coupling holes of the plurality of shelves; and a stopper portion inserted into the plurality of coupling holes of the plurality of shelves and formed to protrude in a radial outward direction from the rod portion so that the stopper portion is caught by one of the plurality of shelves, the stopper portion includes a center stopper provided to be caught between the plurality of shelves and an auxiliary stopper provided to be spaced apart from the center stopper so that the auxiliary stopper is caught by one of the plurality of shelves, the auxiliary stopper is inserted through all of the plurality of coupling holes, and the center stopper is inserted through any one of the plurality of coupling holes.

2. The refrigerator according to claim 1, wherein each of the plurality of coupling holes includes:

a center region formed in a circular shape; and a guide region formed to extend in a radial outward direction from the center region.

3. The refrigerator according to claim 2, wherein the rod portion has a cross-sectional region corresponding to a shape and size of the center region.

4. The refrigerator according to claim 2, wherein the stopper portion has a cross-sectional region corresponding to a shape and size of the guide region.

5. The refrigerator according to claim 2, wherein the adjustment member includes:

a grip portion protruding in a radial outward direction from the rod portion so that the grip portion is spaced apart from the center stopper and is grasped by a user hand.

6. The refrigerator according to claim 5, wherein the grip portion is caught by one of the plurality of shelves such that an insertion depth of the adjustment member is restricted when the adjustment member is inserted into the plurality of coupling holes of the plurality of shelves.

7. The refrigerator according to claim 2, wherein the adjustment member is inserted into the plurality of coupling holes of the plurality of shelves in a longitudinal direction of the rod portion, and is fixed to the plurality of shelves by rotating about a longitudinal center axis of the rod portion.

8. The refrigerator according to claim 1, wherein each of the plurality of shelves includes:

a shelf plate allowing food to be placed thereon, and a hanger coupled to the shelf support portion to support the shelf plate, wherein at least one of the plurality of coupling holes is formed in the hanger.

9. The refrigerator according to claim 8, wherein the hanger includes:

a horizontal portion formed parallel to the shelf plate; and a vertical portion extending downward from the horizontal portion, and wherein the at least one of the plurality of coupling holes is formed in the vertical portion.

10. A refrigerator comprising:

a main body;

a storage chamber formed in the main body;

a shelf support portion provided at a rear side of the storage chamber;

a first shelf configured to include a first shelf plate and a first hanger coupled to the shelf support portion to support the first shelf plate;

a second shelf arranged next to the first shelf, and configured to include a second shelf plate and a second hanger coupled to the shelf support portion to support the second shelf plate; and an adjustment member coupled to the first shelf and the second shelf to remove a height difference between the first shelf and the second shelf, wherein:

the first hanger is provided with a first coupling hole, the second hanger is provided with a second coupling hole, the adjustment member includes a rod portion extending to be inserted into the first coupling hole and the second coupling hole, and a stopper portion inserted into the first coupling hole and the second coupling hole and protruding from the rod portion to be caught by one of the first hanger and the second hanger, the stopper portion includes a center stopper provided to be caught between the first shelf and the second shelf, and an auxiliary stopper provided to be spaced apart from the center stopper so that the auxiliary stopper is caught by one of the first shelf and the second shelf, the auxiliary stopper is inserted through both of the first coupling hole and the second coupling hole, and the center stopper is inserted through any one of the first coupling hole and the second coupling hole.

11. The refrigerator according to claim 10, wherein the adjustment member is rotatable in a manner that the stopper portion is caught by at least one of the first hanger and the second hanger in a state in which the rod portion is inserted into the first coupling hole and the second coupling hole.

12. The refrigerator according to claim 10, wherein each of the first coupling hole and the second coupling hole includes:

a center region formed in a circular shape; and a guide region formed to extend in a radial outward direction from the center region.

13. The refrigerator according to claim 12, wherein the rod portion has a cross-sectional region corresponding to a shape and size of the center region.

14. The refrigerator according to claim 12, wherein the stopper portion has a cross-sectional region corresponding to a shape and size of the guide region.

15. The refrigerator according to claim 10, wherein the adjustment member includes:

a grip portion protruding in a radial outward direction from the rod portion so that the grip portion is grasped by a user hand.

16. The refrigerator according to claim 15, wherein:

the first hanger is inserted between the auxiliary stopper and the center stopper, and the second hanger is inserted between the center stopper and the grip portion.

* * * * *